US009321466B2

(12) United States Patent
Choi et al.

(10) Patent No.: US 9,321,466 B2
(45) Date of Patent: Apr. 26, 2016

(54) CONTROLLABLE NORMAL FORCE MECHANISM WITH MINIMUM ENERGY CONSUMPTION

(71) Applicant: Massachusetts Institute of Technology, Cambridge, MA (US)

(72) Inventors: Changrak Choi, Cambridge, MA (US); Dimitrios Chatzigeorgiou, Somerville, MA (US); Rached Ben-Mansour, Dhahran (SA); Kamal Youcef-Toumi, Cambridge, MA (US)

(73) Assignees: Massachusetts Institute of Technology, Cambridge, MA (US); King Fahd University of Petroleum and Minerals, Dhahran (SA)

( * ) Notice: Subject to any disclaimer, the term of this patent is extended or adjusted under 35 U.S.C. 154(b) by 307 days.

(21) Appl. No.: 13/854,196

(22) Filed: Apr. 1, 2013

(65) Prior Publication Data

US 2014/0290763 A1 Oct. 2, 2014

(51) Int. Cl.
*B61B 13/00* (2006.01)
*H01F 7/02* (2006.01)

(52) U.S. Cl.
CPC ..... *B61B 13/00* (2013.01); *H01F 7/0242* (2013.01); *Y10S 901/44* (2013.01); *Y10T 137/8359* (2015.04)

(58) Field of Classification Search
CPC ..... B61B 13/00
USPC ..... 73/431
See application file for complete search history.

(56) References Cited

U.S. PATENT DOCUMENTS

| | | | | |
|---|---|---|---|---|
| 3,426,224 | A * | 2/1969 | Esters | 310/46 |
| 5,394,044 | A * | 2/1995 | Yamamura | 310/90.5 |
| 5,521,448 | A * | 5/1996 | Tecza et al. | 310/90.5 |
| 6,448,679 | B1 * | 9/2002 | Imlach | 310/90.5 |
| 6,770,995 | B1 * | 8/2004 | Foshage | 310/90.5 |
| 2002/0074881 | A1 * | 6/2002 | Imlach | 310/90.5 |
| 2013/0229080 | A1 * | 9/2013 | Jones | 310/152 |

FOREIGN PATENT DOCUMENTS

EP 221228 A1 * 5/1987 ..... H02K 41/03

OTHER PUBLICATIONS

Choi, C, "Robot Design for Leak Detection in Water-Pipe Systems", Feb. 16, 2012, Massachusetts Institute of Technology, [online], [retrieved on Apr. 5, 2015]. Retrieved from the Internet: http:Udspace.mit.edulbitstreamlhandlel1721.1/70434/785721101 . pdf>.*

(Continued)

*Primary Examiner* — Lisa Caputo
*Assistant Examiner* — Jamel Williams
(74) *Attorney, Agent, or Firm* — Sam Pasternack; MIT Technology Licensing Office

(57) ABSTRACT

Force control system. The system includes a first pair of permanent magnets for providing a normal force on the wheel of a robot adapted for n-pipe inspections. A second pair of magnets is provided with opposite polarity so that a rotor containing magnets may be rotated with a minimum of torque required and therefore with a minimum of energy expended.

4 Claims, 4 Drawing Sheets

(56) References Cited

OTHER PUBLICATIONS

D. Chatzigeorgiou, K. Youcef-Toumi, A. Khalifa, and R. Ben-Mansour, "Analysis and Design of an In-Pipe System for Water Leak Detection," in ASME International Design Engineering Technical Conferences & Design Automation Conference, 2011, pp. 1-10.
K. Suzumori, T. Miyagawa, M. Kimura, and Y. Hasegawa, "Micro Inspection Robot for 1-in Pipes," in IEEE/ASME Transaction on Mechatronics, 1999, 286-292, vol. 4, No. 3.
S.G. Roh and H.R. Choi, "Differential-Drive In-Pipe Robot for Moving Inside Urban Gas Pipeline," in IEEE Transactions on Robotics, Feb. 2005, 1-17, vol. 21, No. 1.
H.R. Choi and S.M. Ryew, "Robotic System with Active Steering Capability for Internal Inspection of Urban Gas Pipelines," in Mechatronics, 2002, pp. 713-736, 12.
Y.S. Kwon, H. Lim, E.J. Jung, B.Y. Yi, "Design and Motion Planning of a Two-Moduled Indoor Pipeline Inspection Robot," in IEEE International Conference on Robotics and Automation, May 2008, pp. 3998-4003.
T. Oya and T. Okada "Development of a Steerable, Wheel-type In-pipe Robot and its Path Planning," in Advanced Robotics, 2005, pp. 635-650, vol. 19, No. 6.
C. Jun, Z. Deng, and S.Y. Jiang, "Study of Locomotion Control Characteristics for Six-Wheel Driven In-Pipe Robot," in IEEE International Conference on Robotics and Automation, Aug. 2004.
S. Hirose, H. Ohno, T. Mitsui, and K. Suyama, "Design of In-Pipe Inspection Vehicles for 25, 50, 150 Pipes," in IEEE International Conference on Robotics and Automation, May 1999.
M. Komori and K. Suyama, "Inspection robots for gas pipelines of Tokyo Gas," in Advanced Robotics, 2001, pp. 365-370, vol. 15, No. 3.
M. Muramatsu, N. Namiki, R. Koyama, and Y. Suga, "Autonomous Mobile Robot in Pipe for Piping Operations," in International Conference on Intelligent Robots and Systems, 2000.
J. Park, T. Kim, and H. Yang, "Development of an actively adaptable in-pipe robot," in IEEE International Conference on Robotics and Automation, Apr. 2009.
Y. Zhang and G. Yan, "In-pipe inspection robot with active pipe-diameter adaptability and automatic tractive force adjusting," in Mechanism and Machine Theory, 2006, pp. 1618-1631, vol. 42, No. 12.
M.M. Moghaddami and A. Hadi, "Control and Guidance of a Pipe-Inspection Crawler (PIC)," in International Symposium on Automation and Robotics in Construction, Sep. 2005.
S. Fujiwara et al., "An Articulated Multi-Vehicle Robot for Inspection and Testing of Pipeline Interiors," in IEEE/RSJ International Conference on Intelligent Robots and Systems, Jul. 1993.
D. Vokoun, M. Beleggia, L. Heller, and P. Sittner, "Magnetostatic interactions and forces between cylindrical permanent magnets," in Journal of magnetism and Magnetic Materials, 321, 2009, pp. 3758-3763.
J.S. Agashe and D.P. Arnold, "A study of scaling and geometry effects on the forces between cuboidal and cylindrical magnets using analytical force solutions," in J. Phys. D: Appl. Phys.41, 2008, 105001.
J.M. Tur, W. Garthwaite, "Robotic Devices for Water Main In-Pipe Inspection: A Survey," in Journal of Field Robotics, 27(4), 2010, pp. 491-508.

* cited by examiner

PRIOR ART

CONTROLLABLE NORMAL FORCE MECHANISM WITH MINIMUM ENERGY CONSUMPTION

BACKGROUND OF THE INVENTION

This invention relates to a controllable normal force generating mechanism that can be used on an in-pipe inspection robot to control the friction between a robot wheel and a pipe wall to assure proper traction with a minimization of expended energy.

Pipe systems are perhaps the most important infrastructures in modern societies. It is very important to monitor such pipelines in order to ensure proper working conditions. However, most of the pipe networks are buried under the ground and consequently are not easily inspected by human operators. Hence, the deployment of robots inside pipes for inspection purposes is of great interest [1].

Different locomotion strategies are used for in-pipe robots. The most common method, among such strategies, employs wheels attached to legs [17]. Wheels provide efficient means of propulsion but require pressing/normal force to maintain traction with pipe walls. With only a few exceptions [2], almost all wheeled in-pipe robots [3]-[10] use a linkage mechanism similar to the one shown in FIG. 1 to provide this pressing force. This mechanism is effective but has a limitation of being passive. The amount of normal force exerted is determined by the stiffness of the spring and cannot be changed actively.

On the contrary being able to control the normal force applied on the wheel is highly desirable for a number of reasons. First, the required friction force to maintain traction varies in different situations. For example, an in-pipe robot traveling through a vertical section of a pipe will require far more friction that when moving horizontally due to its own weight. But without an ability to adjust the normal force, an in-pipe robot must maintain unnecessarily high friction when traveling through horizontal pipelines in order to climb the vertical sections. This leads to a significant energy loss because most of the pipelines consist of horizontal sections and motors driving the wheel will consume more energy in the presence of high friction. An active normal force generating mechanism can reduce such energy losses by providing just enough friction to keep traction through appropriate feedback control.

Furthermore, a friction varying mechanism provides effective means of controlling the speed of in-pipe robots for liquid pipe networks. Chatzigeorgiou et. al [1] suggest a robot inside a liquid pipe (e.g., water pipeline) that will naturally travel with the flow moving at the speed of the liquid. The active normal force generating mechanism can act as speed-regulating mechanism for such liquid pipe robots. By controlling the friction force with wheels locked, the robot can slow down to the desirable speed from that of liquid flow speed.

A few wheeled in-pipe robots can actively control the normal force [11]-[14] use a similar linkage mechanism to the passive ones. Instead of having a spring on a slider shaft, these robots have either a motor or a pneumatic actuator to press on the linkage. The normal force on the wheel is controlled by varying the force at which the actuator presses on the linkage. However, using a linkage mechanism to actively control the friction force is energy inefficient. It is clear that the higher the friction to be generated, the higher the motor torque required to press on the linkage. Thus, a large friction force can only be produced at an expense of large energy consumption from the motor in prior art designs.

In this patent application, a novel mechanism capable of generating controllable friction force over large ranges with very low torque requirements is presented. Low torque requirements is translated to minimal energy consumption. This in turn can greatly lengthen the operation time of an in-pipe robot.

SUMMARY OF THE INVENTION

In one aspect, the force control system of the invention includes a plurality of first rotor permanent magnets symmetrically disposed around a rotor with each first rotor magnet spaced apart from corresponding first stator permanent magnets mounted for radial motion. The first rotor and stator magnets have the same polarity resulting in the repulsive forces between the first rotor and stator permanent magnets and forming a first rotor/stator magnet pair.

A plurality of second rotor permanent magnets are symmetrically disposed around the rotor at a location apart from the first rotor permanent magnets, each second rotor magnet spaced apart from the first rotor permanent magnets. The second rotor and stator magnets have opposite polarity resulting in attractive forces between the second rotor and stator permanent magnets to form a second rotor/stator magnet pair. Means are provided for rotating the rotor whereby force on the first stator permanent magnets in a radial direction is controlled as the rotor rotates through a selected angular range while the torque required to rotate the rotor is reduced by the second rotor/stator magnet pair.

In a preferred embodiment, a plurality of legs/wheels is attached to the first stator permanent magnets to provide a radial force on the plurality of legs/wheels. In this embodiment, the legs/wheels are adapted to guide and/or propel a robot through a pipeline.

In another aspect, the invention is a robot for in-pipe inspection including a vehicle having symmetrically disposed wheels, the wheels adapted to move in a radial direction to engage the wall of a pipe with a controllable force. A plurality of first rotor permanent magnets are symmetrically disposed around a rotor in the vehicle with each first rotor magnets spaced apart from corresponding first stator permanent magnets mounted for radial motion. The first rotor and stator magnets have the same polarity resulting in repulsive forces between the first rotor and stator permanent magnets and forming a first rotor/stator magnet pair.

A plurality of second rotor permanent magnets are symmetrically disposed around the rotor at a location apart from the first rotor permanent magnets, each second rotor magnets spaced apart from corresponding second stator permanent magnets. The second rotor and stator magnets have opposite polarity resulting in attractive forces between the second rotor and stator permanent magnets to form a second rotor/stator magnet pair. Means are provided for rotating the rotor whereby force on the first stator permanent magnets in a radial direction is controlled as the rotor rotates through a selected angular range to control wheel force against the pipe while the torque required to rotate the rotor is reduced by the second rotor/stator magnet pair.

In a preferred embodiment the vehicle has three symmetrically disposed wheels.

FIGS, 8*a, b, c, d* and *e* are illustrations of a prototype with only stator/rotor pair and with both a leg and an anti-torque stator/rotor pair.

Figure 9:
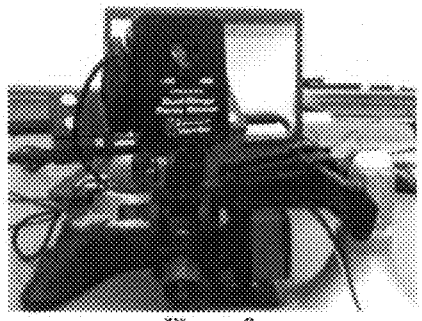

FIG. 9 is an illustration of an experimental setup to measure normal force.

Figure 10:
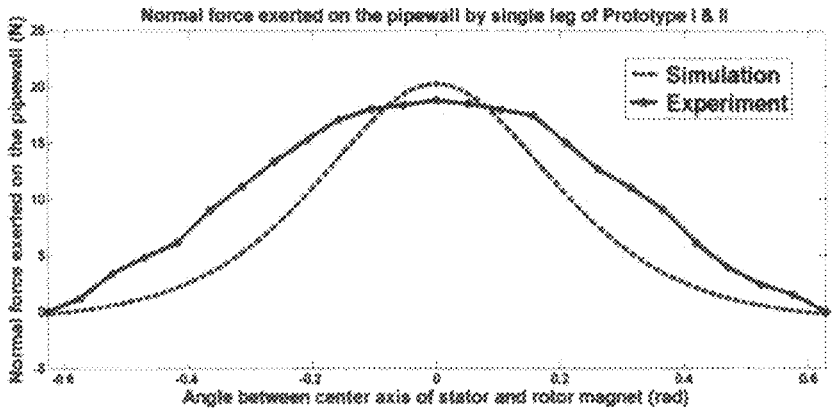

FIG. 10 is a graph of normal force exerted on a pipe wad against angle between center axis of stator and rotor magnet.

Figure 11:
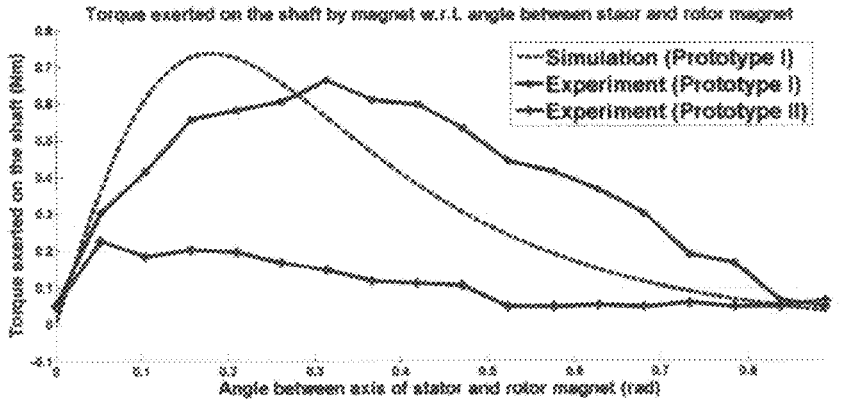

FIG. 11 is a graph of torque exerted on the shaft versus angle between axis of stator and rotor magnets.

DESCRIPTION OF THE PREFERRED EMBODIMENT

Figure 1:
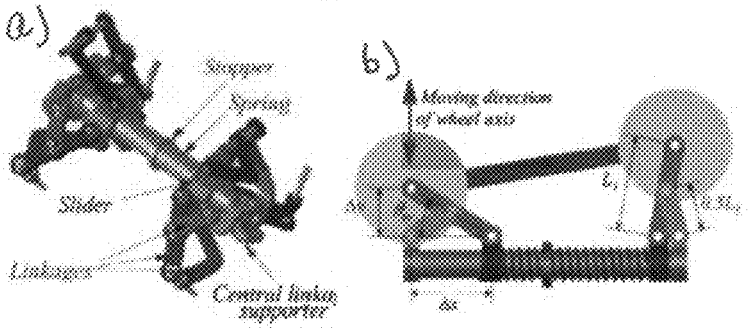
FIGS. 1*a* and *b* are schematic illustrations of a typical prior art linkage mechanism used to provide a normal force on wheels of a pipe inspection robot.
Figure 2:
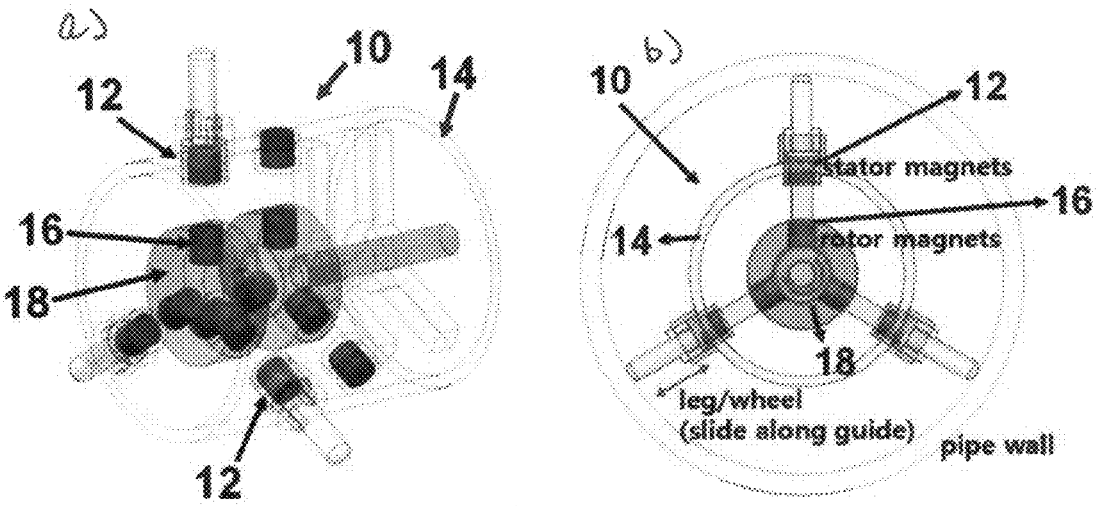
FIGS. 2*a* and *b* are perspective and front views of the force control system disclosed herein.
Figure 3:
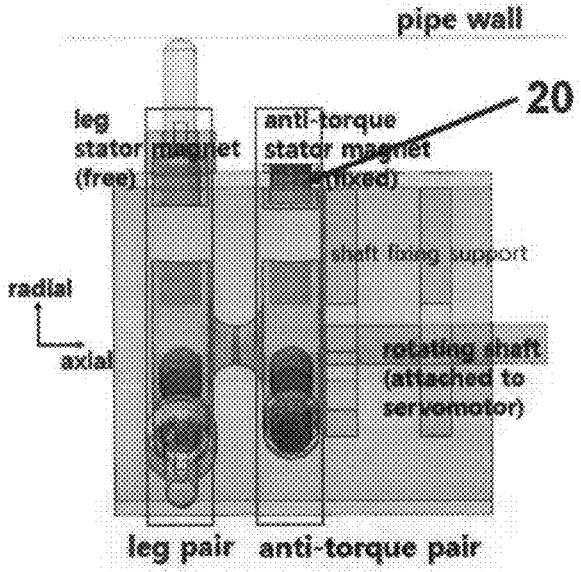
FIG. 3 is a side view of the force control mechanism disclosed herein.

The mechanism described in this patent application makes use of a magnetic force between permanent magnets to produce an adjustable normal force on the wheel/leg of an in-pipe robot. FIGS. 2*a* and *b*, and FIG. 3 display the front and side views of the mechanism 10. It consists of a set of stator magnets 12 that are placed on the circumference of an in-pipe robot 14 and a set of rotor magnets 16 attached to a disk 18 rotated by a shaft connected to a servomotor (not shown).

The set of stator magnets 12 consists of two pairs. The leg pair of stator magnets is attached to the end of each leg/wheel with the north pole facing inward. This pair of stator magnets can move freely in the radial direction as the leg/wheel slides along the guide. An anti-torque pair of stator magnets 20 is placed along the circumference of the in-pipe robot at a certain distance away from the leg pair 12. This anti-torque pair 20 of stator magnets is fixed in place and most importantly has magnetic poles reversed from the leg pair with north pole facing outward.

The set of rotor magnets also consists of two pairs. Each pair is mounted on the disk 18 with both pairs having the north pole facing outwards. The two disks with rotor magnets are attached to a single shaft rotated by a servomotor. The two disks are positioned such that the set of stator magnets are directly above the rotor magnets. Also, both stator and rotor magnets are symmetrically placed with equal spacing.

The leg stator/rotor pair attached to the leg and the shaft work together to produce a controllable normal force. The magnetic force on the stator magnet 12 by the rotor magnet 16 produces the normal force on the pipe wall, which in turn creates friction. Here, a new variable $\theta$ is introduced which equals the angle between the rotor and stator magnet as shown in FIGS. 4*a* and *b*. This angle $\theta$ is controlled by the rotating disk 18 via a servomotor (not shown).

Figure 4:
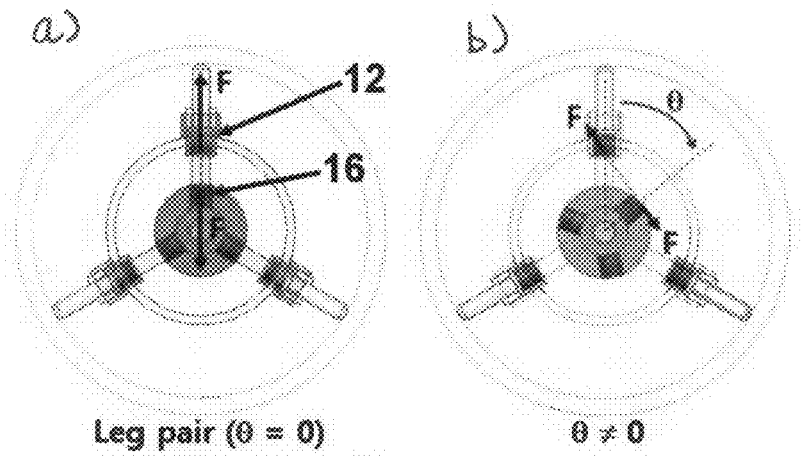
FIGS. 4*a* and *b* illustrate stator and rotor magnets at different angular configurations.

FIG. 4 shows two instances where $\theta=0$ and $\theta\neq0$ with repulsion force between north poles of rotor/stator magnets. Qualitatively speaking, the repulsion force decreases as the distance between the north poles increases. When $\theta=0$, the distance between the north poles is smallest and the repulsion force is in the direction of the normal force. So, the maximum normal force is produced at this position. As the shaft rotates and $\theta$ increases, the distance between the north poles also increases and the direction of repulsion force deviates more from the direction of the normal force. As a result, the normal force produced by the mechanism will decrease as $\theta$ increases. Therefore, by calibration of the output of the normal force, obtaining an accurate $F_n(\theta)$ curve and controlling the angle $\theta$, we can control the normal force of the mechanism, However, although the magnetic force on the stator by the rotor produces a desirable normal force, an equal and opposite magnetic force on the rotor by the stator produces torque on the shaft that needs to be overcome by the servomotor. The greater the desired normal force, the greater he required torque needed to be overcome. Since a motor consumes a lot of energy in providing high torque, a leg pair of stator/rotor magnets alone cannot produce normal force in an energy efficient way.

For the mechanism 10 to generate a normal force with minimal energy consumption, the torque imposed on the shaft must be reduced. The anti-torque pair of rotor and stator magnets is incorporated into the mechanism for this purpose.

Figure 5:
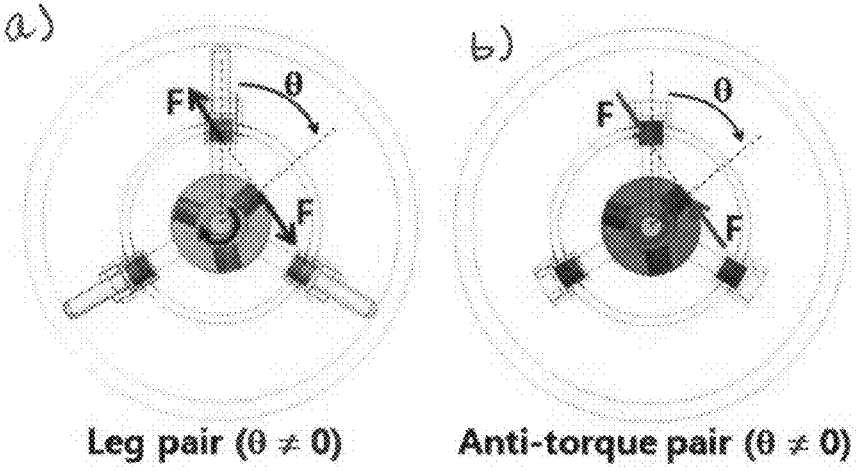
FIGS. 5*a* and *b* are schematic illustrations comparing magnetic forces and torques produced by the leg and anti-torque pair of magnets.

FIGS. 5*a* and *b* show a magnetic force between the leg and anti-torque pair of the stator/rotor magnets at a given angle $\theta$. Configuration wise, both leg and anti-torque pair of the magnets are the same. Nevertheless, there are two main differences between the two pairs.

First, the stator magnet 12 on the leg pair is attached to an end of the leg/wheel whereas the stator magnet 20 on the anti-torque pair is fixed on the circumference of the in-pipe robot. Therefore, the magnetic force on the stator by the rotor in the anti-torque pair does not contribute to the normal force generated on the pipe wall.

Second, the poles of the stator magnet 20 on the anti-torque pair are opposite of that of the leg pair. This means that the force acting on the rotor magnet by the stator magnet 20 in the anti-torque pair is equal but opposite in direction from that of the leg pair. Thus, the torque that the anti-torque pair produces exactly cancels out the torque produced by the leg pair on the shaft. Theoretically, this cancellation will reduce the torque exerted on the shaft to zero and will therefore eliminate the energy consumption.

Figure 6:
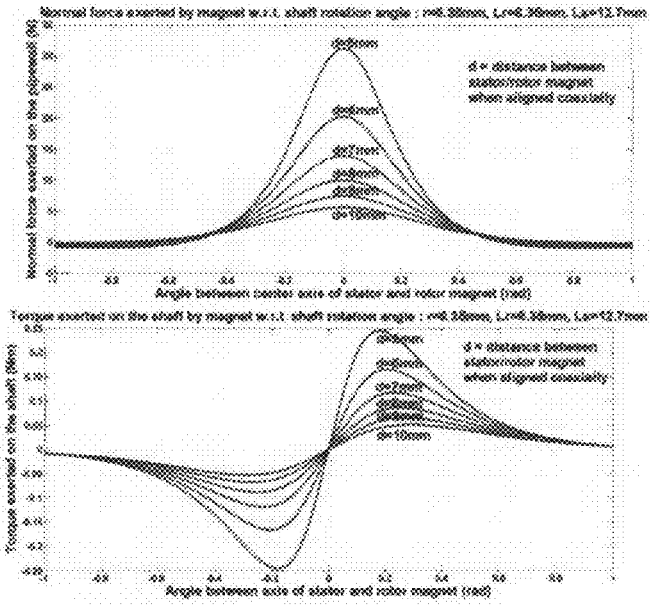
FIG. 6 includes graphs of torque and normal force produced with a single stator/rotor magnet.

FIG. 6 shows the changes in normal force on the pipewall and changes in the torque on the shaft as the angle $\theta$ varies from $-60°$ to $+60°$ for different values of $\sigma$. As expected, the maximum normal force occurs when $\theta=0$. Another interesting point is that the normal force actually becomes negative around 35°. The angle at which the normal force switches from positive to negative is the point where repulsion forces from like poles are exactly equal to the attraction forces of opposite poles. This phenomenon is desirable since it results in the servomotor controlling the shaft rotation needing to turn from 0° to around 35° only to provide a normal force from zero to maximum $F_n$.

The torque graph indicates that although $\tau=0$ when $\theta=0$, this is an unstable equilibrium point. The torque sharply increases with a small deviation from $\theta=0$ and reaches maximum between 10° and 20°. Also note that a smaller distance between the stator/rotor magnets produces a larger normal force as well as higher torque.

Figure 7:
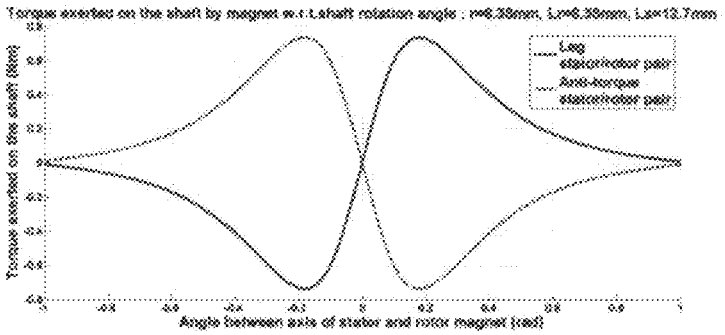
FIG. 7 is a graph of torque exerted on a shaft versus angle between the axis of stator and rotor magnets.
Figure 8:
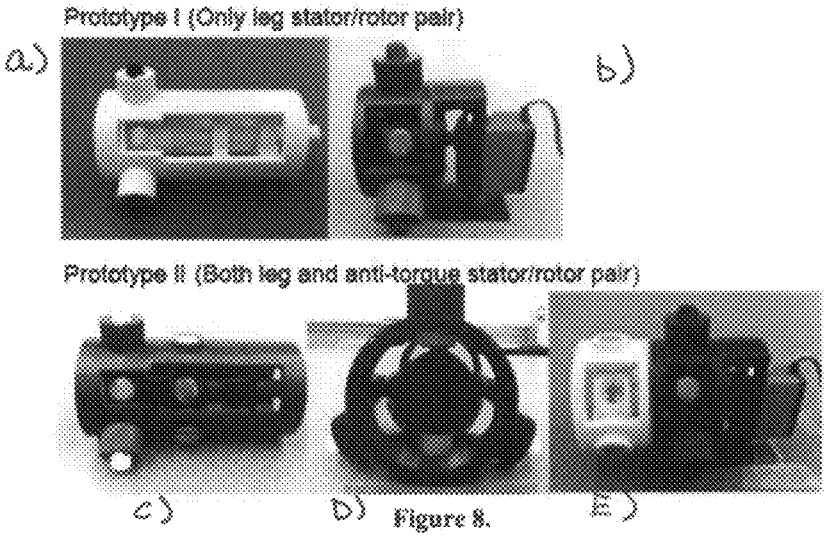

From simulated results, the anti-torque pair of the stator/rotor magnets discussed above provides an effective way of reducing the torque on the shaft. The front and rear pair of stator/rotor magnets, being in the same configuration but having opposite polarity, results in two pairs producing equal but opposite torque as shown in FIG. 7.

Two prototypes were built to demonstrate the working of the mechanism introduced in this patent and verify the simulation analysis. The different parts were 3D printed and the material used was ABS plastic.

Prototype I was built with only the leg stator/rotor pair and prototype II was built with both leg and anti-torque stator/rotor pair (FIGS. 8*a-e*). This was done to verify the torque cancelling effect of the anti-torque pair.

For both prototypes, the rotor magnets are cylindrical NdFeB magnets ($B_0$=1T) of radius 6.35 mm and length 6.35 mm. Stator magnets have the same radius but twice the length as that of the rotor magnets. The distance between the rotor and the stator magnets when aligned coaxially is 6 mm.

Two experiments were carried out to verify the performance of the mechanism. The first experiment measured the normal force exerted by a single leg as a function of rotation angle θ. As shown in FIG. 9, a force sensor with resolution of 0.05N was used to measure the normal force and the angle of the rotor shaft was controlled by a servo-motor attached to it.

The second experiment was conducted to find the torque exerted on the rotor shaft by the repulsion force between rotor and stator magnets. However, instead of directly measuring the torque exerted on the rotor shaft, current drawn by the servo-motor was measured while supplying a constant voltage. Then from the current data, torque generated by the servo-motor was calculated which is equal to the torque exerted on the rotor shaft by the magnets. This was done for both prototypes I and II.

FIG. 10 shows the normal force exerted by one leg on the pipewall for different values of shaft angle θ. As predicted through analysis, the normal force is maximum when the rotor and stator magnets are aligned coaxially (θ=0). From this maximum value, the normal force gradually falls as the rotor shaft turns and becomes zero around 35° in accordance with the simulation results.

This result shows that by controlling the rotor shaft angle between 0° to 35° (via a servomotor), the mechanism presented is able to generate a controllable friction force. Furthermore, normal forces measured through experiment agree well with the simulation results.

One may note that the graph from the experimental data is more widely spread than that of the simulation result. This may be due to the fact that in the process of theoretical analysis, a magnet was modeled as having point magnetic charges at both ends. In reality, the magnetic charge is not focused at one point but rather spread out along the magnet surface.

The experimental result of FIG. 11 shows how torque exerted on the rotor shaft changes with shaft angle θ. The torque for the prototype I sharply rises from aero as the shaft deviates from θ=0 and then gradually falls to zero after reaching the maximum value. The overall shape of the graph for prototype I is in accordance with the simulation result which again verifies the validity of the simulation analysis.

More significantly, prototype II exhibits a great reduction in the torque compared to prototype I. This shows the effectiveness of the anti-torque stator/rotor pair in cancelling out the torque of the leg stator/rotor pair. The area under the torque-angle curve represents the energy consumed by the mechanism in rotating the rotor shaft to create a controllable friction force. From the experimental data, the anti-torque stator/rotor pair of prototype II reduced the energy consumption by 76% in comparison to that of prototype I.

Theoretically, due to symmetry of the torque generated and cancelled by the leg and anti-torque stator/rotor pair, prototype II should have zero torque for all angle θ. The consequence of this is that the mechanism can provide controllable friction force by rotation of a shaft while spending almost no energy in the process. However, this is not the case and a small resistive torque exists as the shaft turns as shown in the experimental result for prototype II. One main reason for this lies in the fact that the servo-motor draws a small current even when there is no external torque applied on the shaft. Another reason could be that the prototype is not perfectly machined. Any aligning errors of the magnets will perturb the symmetry and give rise to a small torque.

These references are incorporated herein by reference in their entirety.

It is recognized that modifications and variations of the present invention will be apparent to those of ordinary skill in fee art and it is intended that all such modifications and variations be included within the scope of the appended claims.

REFERENCES

[1] D. Chatzigeorgiou, K. Youcef-Toumi, A. Khalifa, and R. Ben-Mansour, "Analysis and Design of an In-Pipe System for Water Leak Detection," in *ASME International Design Engineering Technical Conferences & Design Automation Conference,* 2011.

[2] K. Suzmori, T. Miyagawa, M. Kimura, and Y. Hasegawa, "Micro Inspection Robot for 1-in Pipes," in *IEEE Transactions on Mechatronics*, vol. 4, no. 3, 1999.

[3] S. G. Roh and H. R. Choi, "Differential-Drive In-Pipe Robot for Moving Inside Urban Gas Pipeline," in *IEEE Transactions on Robotics*, vol. 21, no. 1, February 2005.

[4] H. R. Choi and S. M. Ryew, "Robotic System with Active Steering Capability for Internal Inspection of Urban Gas Pipelines, " in *Mechatronics,* 12, 2002, pp. 713-736.

[5] Y. S. Kwon, H. Lim, E. J. Jung, B. Y. Yi, "Design and Motion Planning of a Two-Moduled Indoor Pipeline Inspection Robot, " in *IEEE International Conference on Robotics and Automation*, May 2008.

[6] T. Oya and T. Okada, "Development of a Steerable, Wheel-type In-pipe Robot and its Path Planning," in *Advanced Robotics*, vol. 19, no. 6, 2005, pp. 635-650.

[7] C. Jun, A. Deng, and S. Y. Jiang, "Study of Locomotion Control Characteristics for Six-Wheel Driven In-Pipe Robot, " in *IEEE International Conference on Robotics and Automation*, August 2004.

[8] S. Hirose, H. Ohno, T. Mitsui, and K. Suyama, "Design of In-Pipe Inspection Vehicles for ϕ25, ϕ50, ϕ150 Pipes," in *IEEE International Conference on Robotics and Automation*, May, 1999.

[9] M. Komori and K. Suyama, "Inspection robots for gas pipelines of Tokyo Gas," in *Advanced Robotics*, Vol. 15, No. 3,2001, pp. 365-370.

[10] M. Muramatsu, N. Namiki, R. Koyama, and Y. Suga, "Autonomous Mobile Robot in Pipe for Piping Operations," in *International Conference on Intelligent Robots and Systems*, 2000.

[11] J. Park, T. Kim, and H. Yang, "Development of an actively adaptable in-pipe robot," in *IEEE International Conference on Robotics and Automation*, April 2009.

[12] Y. Zhang and G. Yan, "In-pipe inspection robot with active pipe-diameter adaptability and automatic tractive force adjusting, " in *Mechanism and Machine Theory*, vol. 42, no. 12, pp. 1618-1631.

[13] M. M. Moghaddaml and A. Hadi, "Control and Guidance of a Pipe-Inspection Crawler (PIC)," in *International Symposium on Automation and Robotics in Construction*, September 2005.

[14] S. Fujiwara, R. Kanehara, T. Okada, and T. Sanemori, "An Articulated Multi-Vehicle Robot For Inspection and Testing of Pipeline Interiors," in *IEEE/RSJ International Conference on Intelligent Robots and Systems*, July, 1993.

[15] D. Vokoun, M. Beleggia, L. Heller, and P. Sittner, "Magnetostatic interactions and forces between cylindrical permanent magnets," in *Journal of magnetism and Magnetic Materials*, 321, 2009, pp. 3758-3763.

[16] J. S. Agashe and D. P. Arnold, "A study of scaling and geometry effects on the forces between cuboidal and cylindrical magnets using analytical force solutions," in *J. Phys. D: Appl. Phys.* 41, 2008, 105001.

[17] J. M. Tur, W. Garthwaite, "Robotic Devices for Water Main In-Pipe inspection: A Survey, " in *Journal of Field Robotics,* 27(4), 2010, pp. 491-508.

What is claimed is:

1. Force control system comprising;

a plurality of first rotor permanent magnets symmetrically disposed around a rotor, each first rotor magnet spaced apart from corresponding first stator permanent magnets mounted for radial motion, the first rotor and stator magnets having the same polarity resulting in repulsive forces between the first rotor and stator permanent magnets forming a first rotor/stator magnet pair;

a plurality of second rotor permanent magnets symmetrically disposed around the rotor at a location apart from the first rotor permanent magnets, each second rotor magnets spaced apart from corresponding second stator permanent magnets, the second rotor and stator magnets having opposite polarity resulting in attractive forces between the second rotor and stator permanent magnets to form a second rotor/stator magnet pair; and means for rotating the rotor, whereby force on the first stator permanent magnets in a radial direction is controlled as the rotor rotates through a selected angular range while the torque required to rotate the rotor is reduced by the second rotor/stator magnet pair.

2. The system of claim 1 including a plurality of legs/wheels attached to the first stator permanent magnets to provide a radial force on the plurality of legs/wheels.

3. The system of claim 2 wherein the legs/wheels are adapted to propel a robot through a pipe.

4. Robot for in-pipe inspection comprising:

a vehicle having symmetrically disposed wheels, the wheels adapted to move in a radial direction to engage the wall of a pipe with a controllable force;

a plurality of first rotor permanent magnets symmetrically disposed around a rotor in the vehicle, each first rotor magnet spaced apart from corresponding first stator permanent magnets mounted for radial motion, the first rotor and stator magnets having the same polarity resulting in repulsive forces between the first rotor and stator permanent magnets and forming a first rotor/stator magnet pair;

a plurality of second rotor permanent magnets symmetrically disposed around the rotor at a location apart from the first rotor permanent magnets, each second rotor magnet spaced apart from corresponding second stator permanent magnets, the second rotor and stator magnets having opposite polarity resulting in attractive forces between the second rotor and stator permanent magnets to form a second rotor/stator magnet pair; and means for rotating the rotor, whereby force on the first stator permanent magnets in a radial direction is controlled as the rotor rotates through a selected angular range to control wheel force against the pipe while the torque required to rotate the rotor is reduced by the second rotor/stator magnet pair.

* * * * *